United States Patent [19]

Sing et al.

[11] Patent Number: 4,789,437

[45] Date of Patent: Dec. 6, 1988

[54] PULSE ELECTROPLATING PROCESS

[75] Inventors: Miu W. Sing, Kowloon; Fung Y. Sing, Aberdeen, both of Hong Kong

[73] Assignee: University of Hong Kong, Hong Kong

[21] Appl. No.: 884,706

[22] Filed: Jul. 11, 1986

[51] Int. Cl.[4] ..... C25D 1/04; C25D 3/50

[52] U.S. Cl. ..... 204/12; 204/47; 204/DIG. 9

[58] Field of Search ..... 204/DIG. 9, 47, 12, 204/13, 27

[56] References Cited

U.S. PATENT DOCUMENTS 2,895,889 7/1959 Schumpelt ..... 204/47
3,775,267 11/1973 Yahalom ..... 204/47

FOREIGN PATENT DOCUMENTS 1922421 11/1970 Fed. Rep. of Germany ..... 204/47
434140 12/1974 U.S.S.R. ..... 204/47

OTHER PUBLICATIONS

J. Cl. Puippe et al., Plating and Surface Finishing, pp. 68–72, Jun. 1980.

V. A. Lamb, Plating, pp. 909–913, Aug. 1969.

"Morphology and Crystallographic Features of Silver Deposits in the Pulsed Current Electrolysis," T. Hayashi, et al., *AES Second International Pulse Plating Symposium,* Oct. 1981, No. 26, p. 1; Paragraphs 1 and 4; No. 54, p. 1–2; No. 75, Table 2.

"Pulse-Plated Deposits of Gold and Rhenium," K. Hosokawa, et al., *Plating and Surface Finishing,* Oct. 1980, pp. 52–56.

"To Pulse . . . or Not to Pulse," M. Murphy, *Metal Finishing,* Jun., 1979, p. 7.

"Influence of Pulse Parameters On Properties of Deposits," J. Cl. Puippe, et al., Amer. Electroplaters' Society, 4/19–4/20, 1979.

"Rhodium—Electrodeposition and Applications," M. Pushpavanam, et al., *Surface Technology,* vol. 12 (1981), pp. 351–360.

*Primary Examiner*—G. L. Kaplan

*Attorney, Agent, or Firm*—Townsend and Townsend

[57] ABSTRACT

A process is provided for obtaining crack-free deposits of rhodium by a pulse electroplating process.

23 Claims, 9 Drawing Sheets

The effect of rhodium concentration on the current efficiency

N.B. 1) Temperature of bath = 18 - 20°C
2) $H_2SO_4$ concentration = 100 ml/1
3) c.d. for both D.C. and Pulse method = 40 mA/cm$^2$
4) For Pulse method, O/F ratio = 1/9

The porosity of the rhodium coating

FIG.12 The contact resistance of the rhodium coating
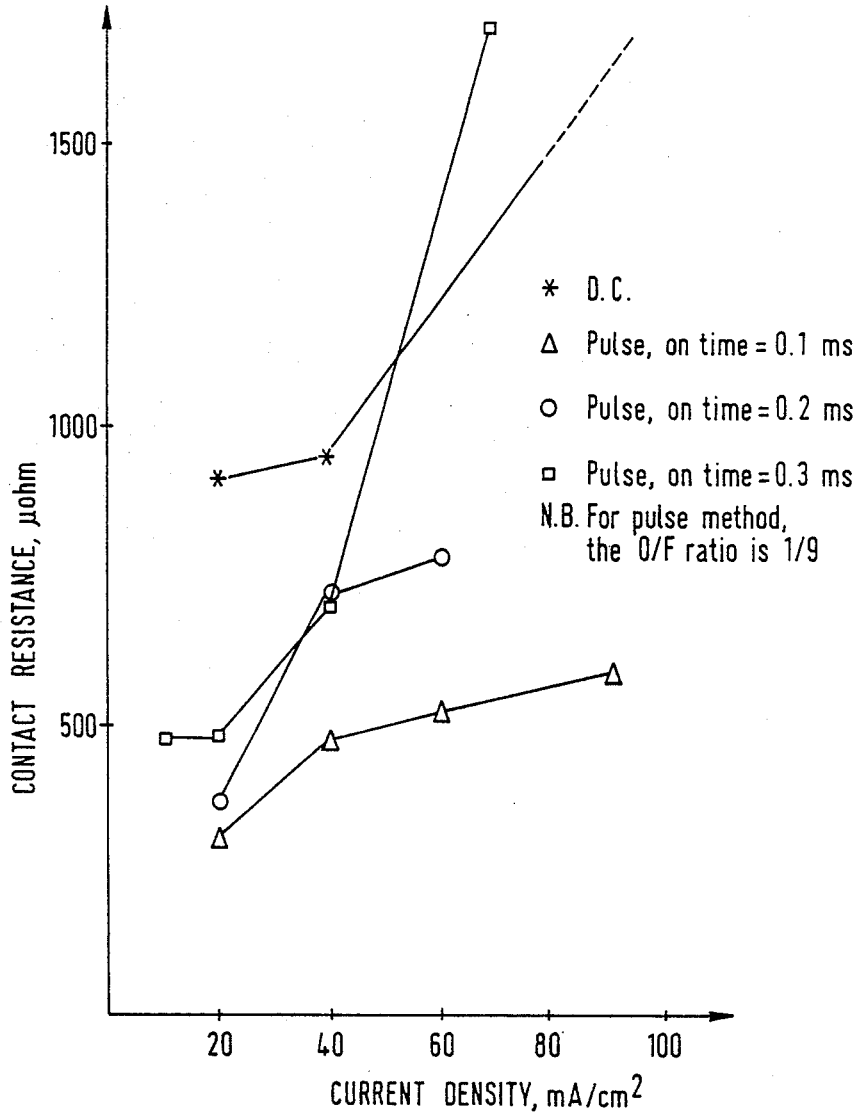

PULSE ELECTROPLATING PROCESS

The present invention relates to a process for producing crack-free rhodium electrodeposits on different metal substrates and to form electrochemically thin rhodium sheets or foils.

BACKGROUND TO THE INVENTION

Rhodium is the hardest, whitest and most chemically stable of the platinum-group of metals, but it is also one of the most expensive. Rhodium is used as a thick coating for engineering use for various applications involving repetitive wear and to protect electrical and electronic components from atmospheric corrosion, particularly at high temperatures. Particular examples of the use of rhodium as a coating are slip-rings and switches in tele-communication equipment and high speed computer switches and sliding contacts. Additionally rhodium is also used at a thickness of from 0.05 to 2 μm on silverware and jewellery, at a thickness of from 1.25 to 6.25 μm on reflector and searchlight surfaces and at a thickness of from 0.05 to 25 μm on electrical contacts. In general the thicker the deposit the better the protection but it is difficult to deposit, a thick layer of rhodium without cracking due to build-up of internal stresses. With methods of coating used at the present time, the conditions of plating have to be carefully controlled to prevent cracking and because of this, the uses of rhodium as a coating are not as widespread as for other platinum-group metals. Processes that use special additives such as selenium and magnesium have been proposed. Processes have been proposed by A. E. Yaniv [Plating, 54,721 (1967)] that use particular apparatus. Processes have also been proposed that use high concentration baths of rhodium sulphamate or rhodium sulphate. However it is difficult to obtain crack-free coatings of rhodium at thicknesses greater than 2.5 um using direct current electroplating methods.

It is an object of the present invention to provide a process of producing crack-free rhodium coatings and rhodium sheets or foils, in particular rhodium sheets or foils having a thickness of from 10 μm to 200 μm.

BRIEF SUMMARY OF THE INVENTION

Accordingly the present invention provides a process of producing a rhodium electrodeposit by pulse current electroplating in which the electrolyte comprises rhodium sulfate/sulfuric acid with a rhodium metal concentration of from 1 to 20 g/L and a sulfuric acid concentration from 25 to 200 mL concentrated (95–98%) sulfuric acid per liter, an ON/OFF-TIME ratio of from 1:20 to 1:4.5 with an ON-time of from 0.05 to 0.8 ms and an OFF-time of from 0.45 to 7.2 ms and an average current density of from 5 to 3,200 mA/cm$^2$.

Preferably the concentration of rhodium metal in the electrolyte is from 3 to 10 g/L and most preferably from 3 to 5 g/L.

Preferably the concentration of sulfuric acid in the electrolyte is from 50 to 150 mL concentrated (95–98%) sulfuric acid per liter and most preferably from 100 to 150 mL concentrated (95–98%) sulfuric acid per liter.

The electrolyte can be prepared by using one the following methods (1) Rhodium chloride is reduced to rhodium metal powder in making a rhodium sulfate electrolyte using formaldehyde as the reducing agent.

(2) Rhodium metal powder is mixed with potassium hydrogen sulfate and then fused at 450° to 550° C. (preferably 500° C.) for one to two hours (preferably two hours) and then at 550° to 650° C. (preferably 600° C.) for two to four hours (preferably three hours).

(3) The rhodium sulfate from (2) above is refined using 10% to 30% (preferably 20%) potassium hydroxide solution to precipitate the rhodium ion. The pure rhodium hydroxide is then dissolved in 1:1 to 1:2 (preferably 1:1) sulfuric acid.

It has been found that the prefered pulse current ON/OFF-time ratio is 1:4.5 with the most prefered range being 1:9. Preferably ON-times are 0.05 to 0.5 ms most preferably 0.1 to 0.3 ms and preferred OFF-times are 0.45 to 4.5 ms and most preferably 0.9 to 2.7 ms.

The preferred current density is from 10 to 1600 mA/cm$^2$, most preferably from 10 to 800 mA/cm$^2$.

The process may be carried out at any temperature, preferably within the broad range of from 10° to 55° C., more preferably 10° to 40° C. and most preferably from 20° to 40° C.

During the process, the electrolyte can be agitated if desired.

We have found that the preferred anode is platinum gauze or platinized or rhodium plated titanium mesh.

It has been found that the process can be used very satisfactorily to plate rhodium onto brass, silver, nickel, gold, titanium, steel or molybdenum and the types of plating that can be used include rack plating, bath plating, jet plating and brush plating.

It is also possible to use the process of the present invention to prepare rhodium sheets or foils, in which case the rhodium may be deposited onto a brass substrate which is subsequently dissolved in concentrated nitric acid or dilute nitric acid of a concentration of 1:1 to leave a rhodium foil or sheet preferably having a thickness of from 10 to 200 μm.

Particular industrial applications of the process of the present invention are those outlined above and the process has been used particularly satisfactorily in plating contact point relays to increase their usable life by at least five times compared with rhodium plated contact point relays produced by conventionally used plating methods. This is because the deposit produced is of both the desired thickness to give long life but is also crack-free.

BRIEF DESCRIPTION OF THE DRAWINGS

The invention will now be described by way of example with reference to the accompanying drawings, in which:

FIG. 12 is a graph showing the contact resistance of rhodium coatings obtained by the direct current method and the pulse-current process of the present invention with ON-times of 0.1 ms, 0.2 ms and 0.3 ma and an ON:OFF ratio of 1:9.

Figure 1:
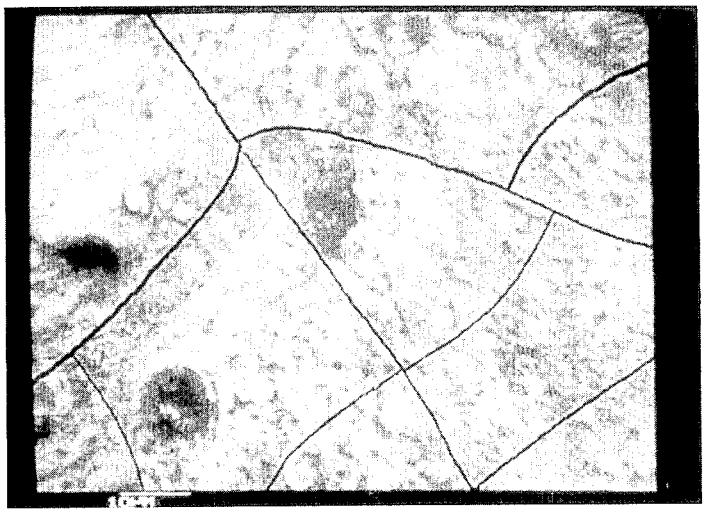
FIG. 1 is a scanning electron microscope photograph of a rhodium electrodeposit obtained using direct current plating for 60 minute at 80 mA/cm$^2$.

The following examples are offered by way of illustration and not by way of limitation.

Various tests were performed on coatings obtained by direct current plating methods and on coatings obtained by the process of the present invention to evaluate the effectiveness of the process of the present invention under conditions normally obtaining in plating processes.

EXPERIMENTAL

A sulfate solution was prepared with 1 to 3 g/L of rhodium and 10 to 150 mL/L of concentrated (95–98%) sulfuric acid. The rhodium sulfate used was prepared from rhodium powder heated with potassium hydrogen sulfate at 600° C. Flat brass cathodes or 3-mm-diameter rods with a bare (unmasked) area of 0.5 to 1.0 cm$^2$ were buffed, degreased ultrasonically in trichloroethane, cleaned cathodically in an alkaline bath, immersed in a 0.1M sulfuric acid solution and plated with 0.5 to 1.0 μm of silver prior to rhodium plating. A platinum gauze anode surrounded the flat brass cathodes or brass rods. A temperature of 25° C. was used.

Pulse current was generated via a potentiostat as indicated by a commercial square-wave pulse generator or by a homemade waveform generator. Current efficiency was determined gravimetrically while using a copper coulometer to measure the current. The porosity test consisted of immersing plated rods or flat cathodes for 2 minutes in concentrated nitric acid and determining the concentration of zinc and copper in the acid by atomic absorption spectroscopy. Thickness was measured microscopically and was also calculated from current efficiency ($i_d$) and average current density ($i_e$).

$$\text{Thickness} = \frac{k i_d t i_e}{D}$$

where k is the electrochemical equivalent of rhodium (1.278 g/A-hr), t is the total plating time in hours, and D is the density of rhodium (12.44 g/cm$^3$). Current efficiency is calculated as follows:

$$i_e = \frac{100\ m}{i_{av} t k}$$

where m is the mass of the deposit and $i_{av}$ is the average current.

The thickness ranged from 5 to 22 μm for typical deposits.

The surface character of typical rhodium deposits examined by scanning electron microscopy is summarized in the following Table 1.

TABLE 1

Character of Rhodium Deposits Obtained with Pulsed and Direct Current

| On-time, msec | Off-time, msec | On/off ratio | Current density, mA/cm$^2$ Avg. | Current density, mA/cm$^2$ Peak | Plating time, | Character of deposit |
|---|---|---|---|---|---|---|
| 0.1 | 0.4 | 0.25 | 30–160 | 150–800 | 5–250 | Usually cracked |
| 0.1 | 0.5 | 0.20 | 12–80 | 75–480 | 5–130 | Usually cracked |
| 0.2 | 0.8 | 0.25 | 20–120 | 100–600 | 30–45 | Few cracks |
| 0.1 | 0.9 | 0.11 | 20–160 | 200–1600 | 37–120 | Crack-free |
| 0.2 | 1.8 | 0.11 | 20–160 | 200–1600 | 23–120 | Crack-free |
| 0.3 | 2.7 | 0.11 | 20–160 | 200–1600 | 29–120 | Crack-free |
| Direct Current | | — | 20–160 | — | 25–120 | Cracked |

Deposits obtained by direct current cracked and gave a powdery solid whereas a pulse current with an ON-TIME of 0.1, 0.2 or 0.3 mm and an ON:OFF ratio of 0.11 produced crack-free deposits, but coatings obtained with a ratio of 0.20 or 0.25 usually showed cracks similar to those shown in accompanying FIG. 1, which corresponds to a direct current deposit.

Figure 2:
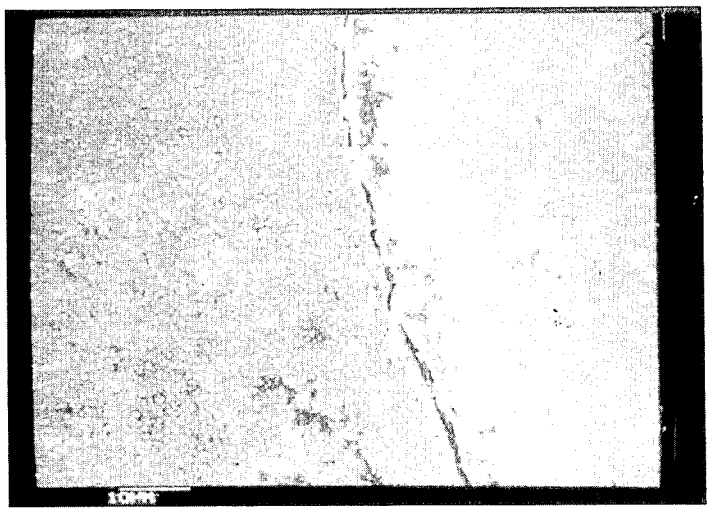
FIG. 2 is a scanning electron microscope photograph of a deposit obtained during a 45 minute pulse-plating process in accordance with the present invention with an average current density of 80 mA/cm$^2$, an ON-time of 0.2 ms and an OFF-time of 0.8 ms.
Figure 3:
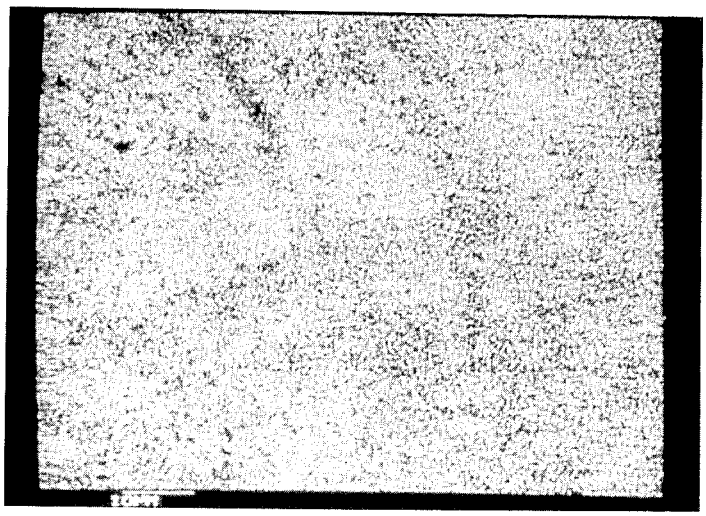
FIG. 3 is a scanning electron microscope photograph of a deposit obtained during a 120 minute pulse-plating process in accordance with the present invention with an average current density of 160 mA/cm$^2$, an ON-time of 0.3 ms and an OFF-time of 2.7 ms.
Figure 4:
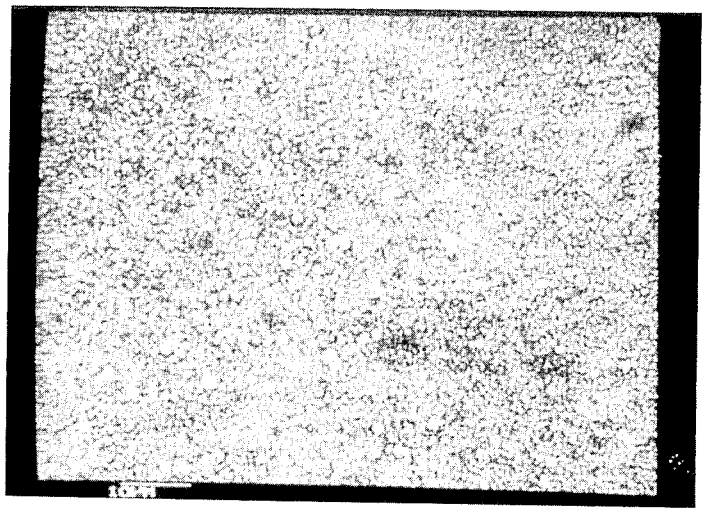
FIG. 4 is a scanning electron microscope photograph of a deposit obtained during a 45 minute pulse-plating process in accordance with the present invention with an average current density of 40 mA/cm$^2$, an ON-time of 0.3 ms and an OFF-time of 5.4 ms.

Accompanying FIG. 2 shows a deposit with only one crack and accompanying FIGS. 3 and 4 are examples of the crack-free deposits obtained with an ON:OFF ratio of 0.11.

Figure 5:
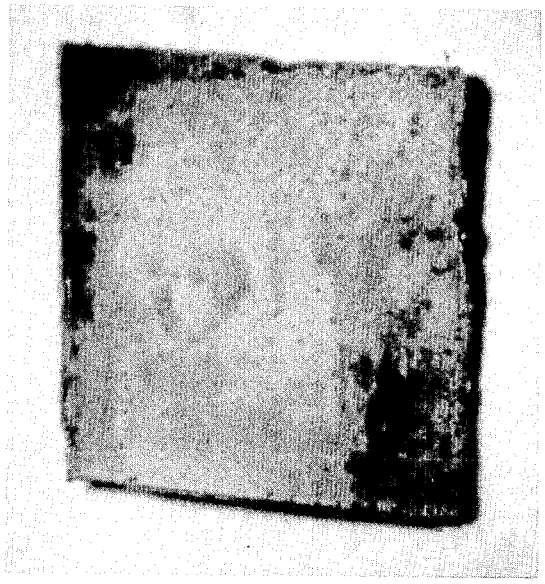
FIG. 5 is a photograph of a crack-free rhodium foil prepared in accordance with the present invention (i.e. pulse-plating of rhodium onto a brass substrate) after the brass substrate obtained from a 90 minute deposit produced with an average current density of 20 mA/cm$^2$, an ON-time of 0.1 ms and an OFF-time of 0.9 ms, was dissolved.
Figure 6:
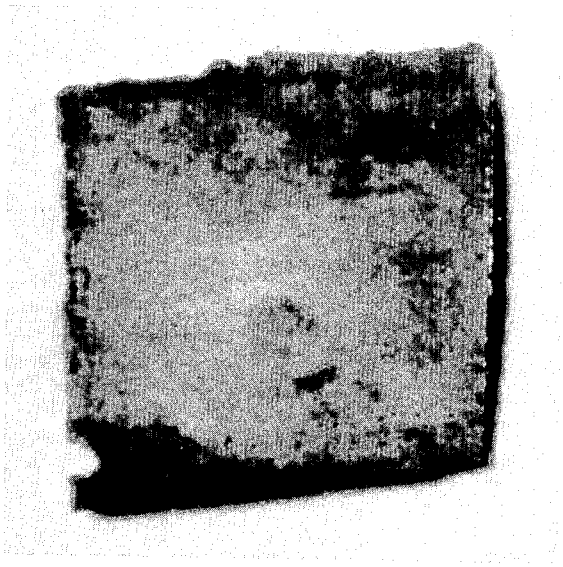
FIG. 6 is a photograph of a crack-free rhodium foil prepared in accordance with the present invention (i.e. pulse-plating of rhodium onto a brass substrate) after brass substrate obtained from a 75 minute deposit produced with an average current density of 20 mA/cm$^2$, an ON-time of 0.2 ms and an OFF-time of 1.8 ms was dissolved.

FIGS. 5 and 6 show examples of crack-free foil that remained after the brass substrate was dissolved. The thickness of these foils are in the range of 6 to 10 μm. By comparison, only small fragments remained after dissolving the brass under typical cracked deposit.

The thickness of some crack-free deposits and pulsing conditions used to obtain them are given in the following Table 2.

TABLE 2

Thickness of Typical Crack-free Deposit

| On-time, msec | Off-time, msec | Avg. current density, mA/cm² | Plating time, min | Thickness, um Micro-scopic | Thickness, um Coulometric |
|---|---|---|---|---|---|
| 0.1 | 0.9 | 20 | 90 | — | 10.8 |
| 0.1 | 0.9 | 40 | 37 | 5.8 | 6.1 |
| 0.1 | 0.9 | 80 | 118 | — | 21.9 |
| 0.2 | 1.8 | 20 | 75 | — | 6.4 |
| 0.3 | 2.7 | 20 | 60 | | 4.7 |
| 0.3 | 2.7 | 30 | 45 | 5.5 | 5.0 |

Figure 7:
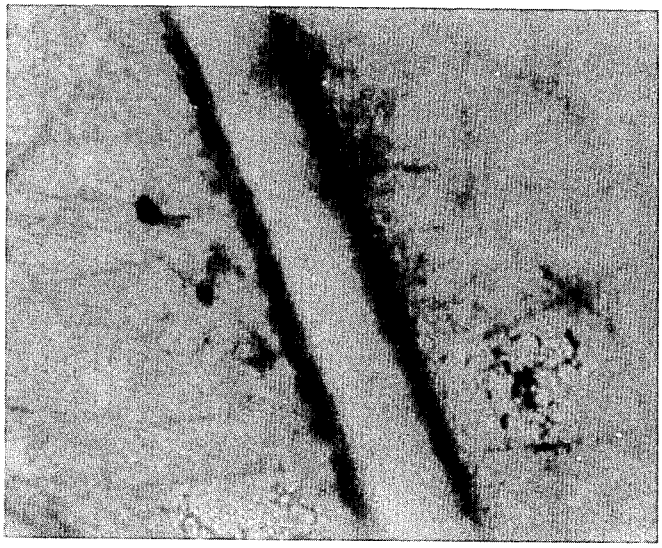
FIG. 7 is a photograph of a cross-section of 5 μm thick 45 minute rhodium deposit obtained in accordance with the present invention with an average current density of 80 mA/cm$^2$, an ON-time of 0.3 ms and an OFF-time of 2.7 ms.
Figure 9:
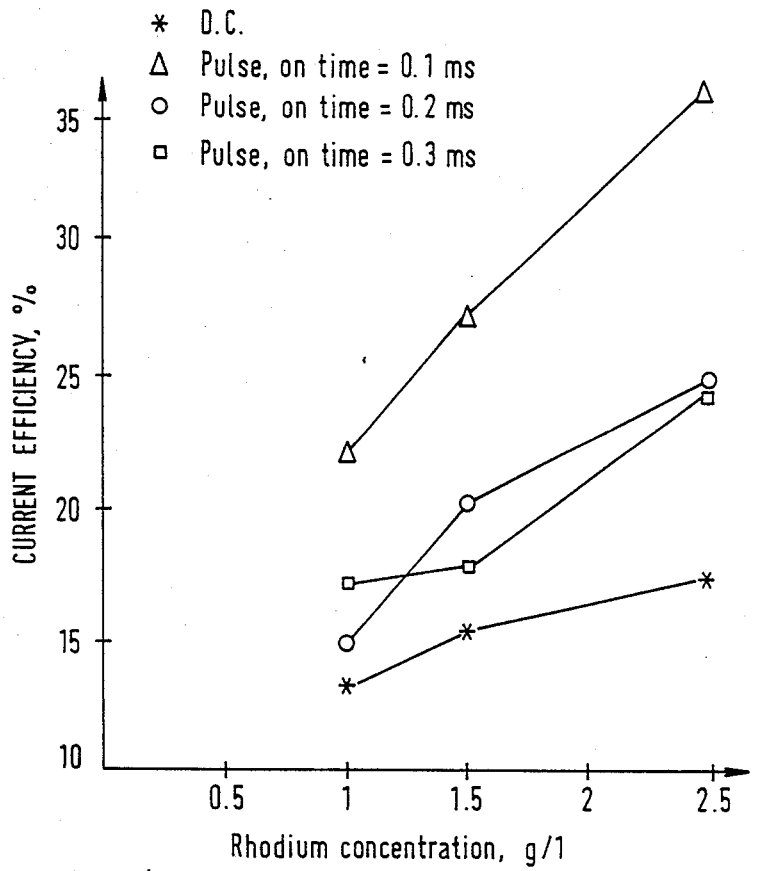
FIG. 9 is a graph showing the effect of rhodium concentration on current efficiency for direct current plating and pulse-plating with ON-times of 0.1 ms, 0.2 ms and 0.3 ms and an ON:OFF ratio of 1:9.

Accompanying figure 7 is cross-section of a 5um thick deposit obtained while using an average current density of 18 mA/cm² during ON and OFF periods of 0.3 and 2.7 ms respectively. The current efficiency data is shown in the following Table 3 and Figure 9.

TABLE 3

Current Efficiency Data

| Average current density, mA/cm² | Current efficiency, percent: Pulse deposit 0.1/0.9 | 0.2/1.8 | 0.3/2.7 | DC deposit |
|---|---|---|---|---|
| 20 | 35.0 | 24.0 | 23.8 | 17.5 |
| 40 | 20.0 | 19.0 | 19.0 | 17.0 |
| 60 | 15.8 | 11.9 | 9.6 | 9.0 |
| 120 | 12.0 | 7.0 | 8.2 | 5.6 |

This shows that current pulsing improved the efficiency as compared to direct current plating. Moreover shorter the plating time, the better will be the current efficiency. A 0.1 ms ON time and an ON:OFF ratio of 0.11 was better than a 0.3 ms ON time with the same ratio.

Figure 10:
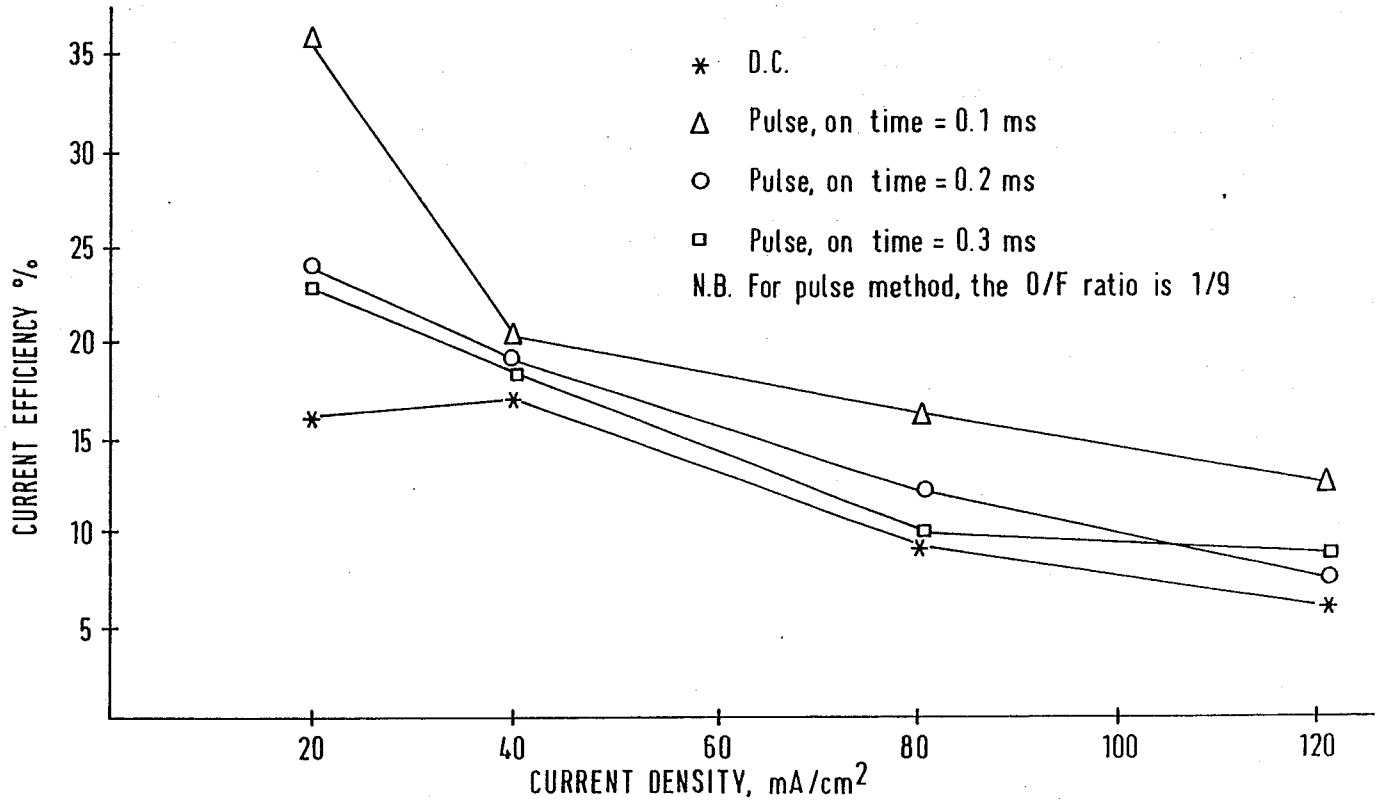
FIG. 10 is a graph showing the effect of current density on current efficiency for direct current plating and pulse-plating with ON-times of 0.1 ms, 0.2 ms and 0.3 ms and an ON:OFF ratio of 1:9.

Current density can also affect the current efficiency as illustrated in FIG. 10 from which it can be seen that the pulse-current process of the present invention is more efficient than the direct current method. Higher current density leads to lower efficiency applying to almost the same extent for the process of the present invention and direct current plating. The short pulse plating time gives the best current efficiency.

The results of tests also showed less porosity for deposits obtained with an ON:OFF ratio of 0.11 by comparison with those obtained with a higher ratio or with direct current plating. The superiority of deposits produced with the ratio of 0.11 was especially noteworthy when the average current density was adjusted to 80 or 120 mA/cm².

Figure 11:
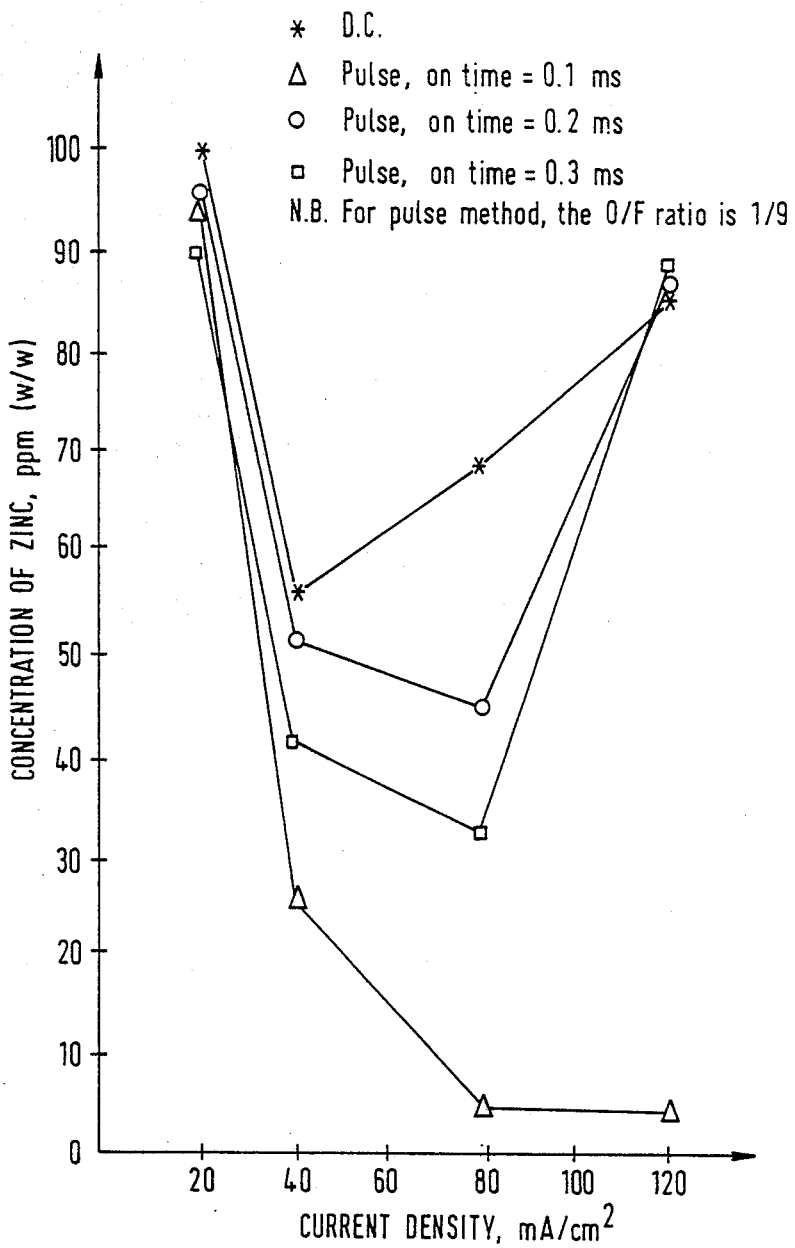
FIG. 11 is a graph showing the porosity of rhodium coatings obtained by the direct current method and the pulse-current process of the present invention with ON-times of 0.1 ms, 0.2 ms and 0.3 ms and an ON:OFF ratio of 1:9

Frant's chemical method was used to indicate the porosity of a coating by measuring the amount of zinc leached out to the solution at given conditions. The results are shown in FIG. 11. The pulse-current process of the present invention produced a less porous coating and for an ON:OFF ratio of 1:9, 0.1 ms ON-time gave the best results.

Figure 8:
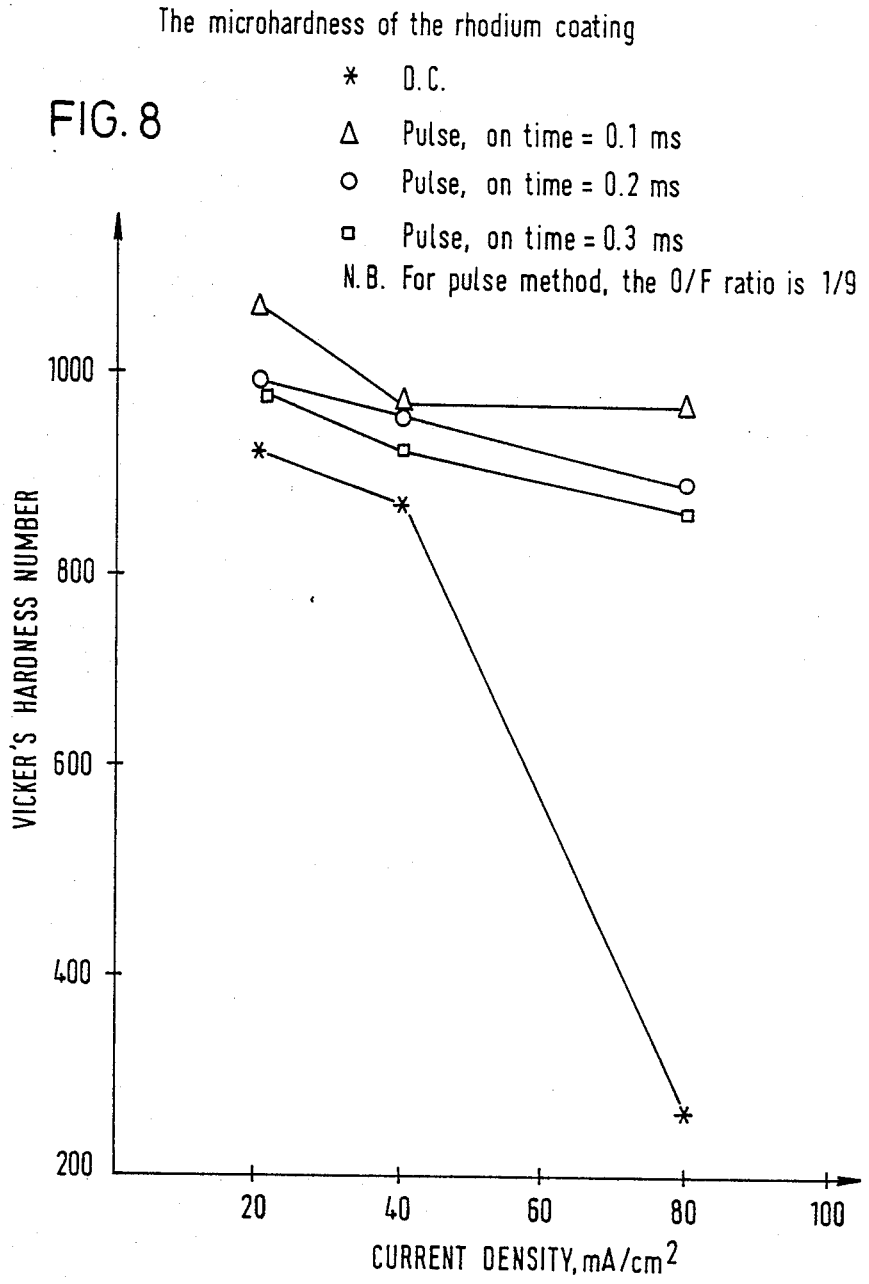
FIG. 8 is a graph showing the relationship between Vicker's Hardness Number (VHN) and current density for direct current plating and pulse-plating with ON-times of 0.1 ms, 0.2 ms and 0.3 ms and an ON:OFF ratio of 1:9.

The microhardness of the deposit was determined using a Leitz microhardness tester, Model DM 1000 and the results are shown in FIG. 8 which clearly indicates that pulse plating produces a harder deposit then direct current plating with a 0.1 ms ON-time pulse at an ON:OFF ratio of 1:9 producing the best results particularly at high current densities where the VHN for the direct current coating drops rapidly.

The microhardness of deposits produced with an ON:OFF ratio of 0.11 and an average current density of 40 or 80 mA/cm² was approximately 980 Vicker's Hardness Number (VHN). Deposits obtained with a larger ratio or with direct current plating were slightly softer and ranged from 900 to 950 VHN.

A comparison of contact resistance measurement is shown in FIG. 12 and the following Table 4.

TABLE 4

Contact Resistance of Rhodium Deposits

| Average current density, mA/cm² | Contact resistance, μohm: Pulsed deposits 0.1/0.9 | 0.2/1.8 | 0.3/2.7 | DC deposit |
|---|---|---|---|---|
| 20 | 300 | 375 | 450 | 900 |
| 40 | 450 | 700 | 700 | 920 |
| 60 | 515 | 750 | — | 1300 |
| 80 | — | — | — | 2570 |

Deposits produced with an ON:OFF ratio of 0.11 exhibited a lower contact resistance than deposits obtained by direct current plating or those obtained with a higher ratio of ON:OFF time.

As shown in FIG. 12 the pulse current process of the present invention is better than the direct current plating methods with an ON-time of 0.1 ms for an ON:OFF ratio of 1:9 being the best.

The above experimental data shows that the pulse-plating conditions suitable for producing good crack-free rhodium deposit consist of an ON-time of 0.1 ms and an OFF-time of 0.9 ms. This also reduced porosity and contact resistance compared with deposits obtained by direct current plating.

With the cycle outlined above a deposit as thick as 22 μm has been obtained without cracks while using an average current density of 80 mA/cm² and a peak current density of 800 mA/cm².

What is claimed is:

1. A process of producing a rhodium electrodeposit by pulse current electroplating in which the electrolyte comprises rhodium sulfate and sulfuric acid with a rhodium metal concentration of from 1 to 20 g/L and a sulfuric acid concentration of from 25 to 200 mL concentrated (95–98%) sulfuric acid per liter, and on/off pulse time ratio of from 1:20 to 1:4.5, with an on-time of from 0.05 to 0.8 ms and an off-time of from 0.45 to 7.2 ms and a peak current density of from 5 to 3,200 mA/cm².

2. A process according to claim 1, wherein the rhodium metal content of the electrolyte is from 3 to 10 g/L.

3. A process according to claim 1, wherein the rhodium metal content of the electrolyte is from 3 to 5 g/L.

4. A process according to claim 1, wherein the sulfuric acid concentration is from 50 to 150 mL concentrated (95–98%) sulfuric acid per liter.

5. A process according to claim 1, wherein the sulfuric acid concentration is from 100 to 150 mL concentrated (95–98%) sulfuric acid per liter.

6. A process according to claim 1, wherein the on/off ratio is 1:4.5.

7. A process according to claim 1, wherein the on/off ratio is 1 to 9.

8. A process according to claim 1, wherein the on-time is from 0.05 to 0.5 ms.

9. A process according to claim 1, wherein the on-time is from 0.1 to 0.3 ms.

10. A process according to claim 1, wherein the off-time is from 0.45 to 4.5 ms.

11. A process according to claim 1, wherein the off-time is from 0.9 to 2.7 ms.

12. A process according to claim 1, wherein the peak current density is from 10 to 1,600 mA/cm$^2$.

13. A process according to claim 1, wherein the peak current density is from 10 to 800 mA/cm$^2$.

14. A process according to claim 1 carried out at a temperature of from 10° to 55° C.

15. A process according to claim 1 carried out at a temperature of from 10° to 45° C.

16. A process according to claim 1 carried out at a temperature of from 20° to 40° C.

17. A process according to claim 1, wherein the electrolyte is mechanically agitated during the pulsing.

18. A process according to claim 1, wherein the anode is selected from platinum, platinum-plated and rhodium-plated titanium.

19. A process according to claim 1, wherein the rhodium is electroplated onto a substrate selected from brass, silver, nickel, gold, titanium, steel and molybdenum.

20. A process according to claim 1, wherein the electroplating method is selected from rack plating, bath plating, jet plating and brush plating.

21. A process of producing a rhodium electrodeposit by pulse current electroplating in which the electrolyte comprises rhodium sulfate and sulfuric acid with a rhodium metal concentration of from 3 to 10 g/L and a sulfuric acid concentration of from 50 to 150 mL concentrated (95–98%) sulfuric acid per liter, and an on/off pulse time ratio of 1:4.5, and an on-time of from 0.05 to 0.5 ms and an off-time of from 0.45 to 4.5 ms and a peak current density of from 10 to 1,600 mA/cm$^2$.

22. A process of producing a rhodium electrodeposit by pulse current electroplating in which the electrolyte comprises rhodium sulfate and sulfuric acid with a rhodium metal concentration of from 3 to 5 g/L and a sulfuric acid concentration of from 100 to 150 mL concentrated (95–98%) sulfuric acid per liter, and on/off pulse time ratio of from 1:9, and an on-time of from 0.1 to 0.3 ms and an off-time of from 0.9 to 2.7 ms and a peak current density of from 10 to 800 mA/cm$^2$.

23. A process of producing a rhodium-sheet or foil by pulse current electroplating in which the electrolyte comprises rhodium sulfate and sulfuric acid with a rhodium metal concentration of from 1 to 20 g/L and a sulfuric acid concentration of from 25 to 200 mL concentrated (95–98%) sulfuric acid per liter, and on/off pulse time ratio of from 1:20 to 1:4.5, with an on-time of from 0.05 to 0.8 ms and an off-time of from 0.45 to 7.2 ms and a peak current density of from 5 to 3,200 mA/cm$^2$, and the process includes the steps of plating the rhodium onto a brass substrate and when the rhodium has been deposited to the desired thickness dissolving away the brass using nitric acid.

* * * * *